US007329136B2

(12) United States Patent
Su et al.

(10) Patent No.: US 7,329,136 B2
(45) Date of Patent: Feb. 12, 2008

(54) BI-DIRECTIONAL ELECTRONIC DEVICE WITH USB INTERFACE

(75) Inventors: Steel Su, Taipei (TW); Toon-Jeow Foo, Singapore (SG); Shen-Feng Huang, Taipei (TW)

(73) Assignee: Behavior Tech Computer Corp., Taipei (TW)

( * ) Notice: Subject to any disclaimer, the term of this patent is extended or adjusted under 35 U.S.C. 154(b) by 0 days.

(21) Appl. No.: 11/365,620

(22) Filed: Mar. 2, 2006

(65) Prior Publication Data

US 2006/0199435 A1 Sep. 7, 2006

(51) Int. Cl.
*H01R 29/00* (2006.01)

(52) U.S. Cl. ..... 439/172

(58) Field of Classification Search ..... 439/172, 439/170, 171, 640, 131
See application file for complete search history.

(56) References Cited

U.S. PATENT DOCUMENTS 7,121,852 B2 * 10/2006 Ng et al. ..... 439/131

* cited by examiner

*Primary Examiner*—Javaid H. Nasri
(74) *Attorney, Agent, or Firm*—Rosenberg, Klein & Lee

(57) ABSTRACT

The present invention provides a bi-directional electronic device with USB interface, comprising a two-in-one USB connector and a USB OTG controller. The two-in-one USB controller has a USB standard-A type male connector and a USB standard-B type female controller, disposed in housing; the two-in-one USB controller is designed so that only the selected USB standard-A type male connector and the USB standard-B type controller can be used for plugging in. The USB OTG controller determines the operation mode of the bi-directional electronic device with the USB interface based on the plugging position of the USB standard-A type male controller and the USB standard-B type controller of the two-in-one controller.

10 Claims, 9 Drawing Sheets

BI-DIRECTIONAL ELECTRONIC DEVICE WITH USB INTERFACE

FIELD OF THE INVENTION

The present invention relates generally to an electronic device with Universal Serial Bus (USB) interface; and more particularly to a USB OTG electronic device.

BACKGROUND OF THE INVENTION

In accordance with the current USB OTG (On-The-Go) specifications, it merely defines the standards for a mini-AB connector, and is used to implement a dual mode electronic device such that the dual mode electronic device can be switched between a host device mode and a slave device mode. When the dual mode electronic device is to connect to other electronic device with USB standard-A type male connector or USB standard-B type female connector, the user will have to use a USB conversion cable for the connection. This type of connection is indeed inconvenient for the user.

The conventional dual mode electronic device is only equipped with a mini-AB connector. One drawback of the conventional dual mode electronic device is that although it satisfies the USB OTG standard, mini-AB connector cannot be directly connected to non-USB OTG connector. Therefore, the inventor adopts a two-in-one connector with USB standard-A type male connector and USB standard-B type female connector to replace the mini-AB connector of conventional dual mode electronic device so as to overcome the inconvenience of the conventional connection.

SUMMARY OF THE INVENTION

One aspect of the present invention is to provide a bi-directional electronic device with USB interface so as to implement a USB OTG dual mode electronic device with USB standard-A type male connector or USB standard-B type female connector.

In order to accomplish the above aspect of the present invention, the present invention provides a bi-directional electronic device with USB interface, comprising a two-in-one connector and a USB OTG connector. The two-in-one USB connector has a USB standard-A type male connector and a USB standard-B type female controller, disposed in housing; the two-in-one USB controller is designed so that only the selected one of the USB standard-A type male connector and the USB standard-B type controller can be used for plugging in. The USB OTG controller determines the operation mode of the bi-directional electronic device with USB interface based on the plugging position of the USB standard-A type male controller and the USB standard-B type controller of the two-in-one controller.

BRIEF DESCRIPTION OF THE DRAWINGS

The above objects and advantages of the present invention will become more apparent with reference to the appended drawings wherein.

DETAILED DESCRIPTION OF THE INVENTION

Figure 1:
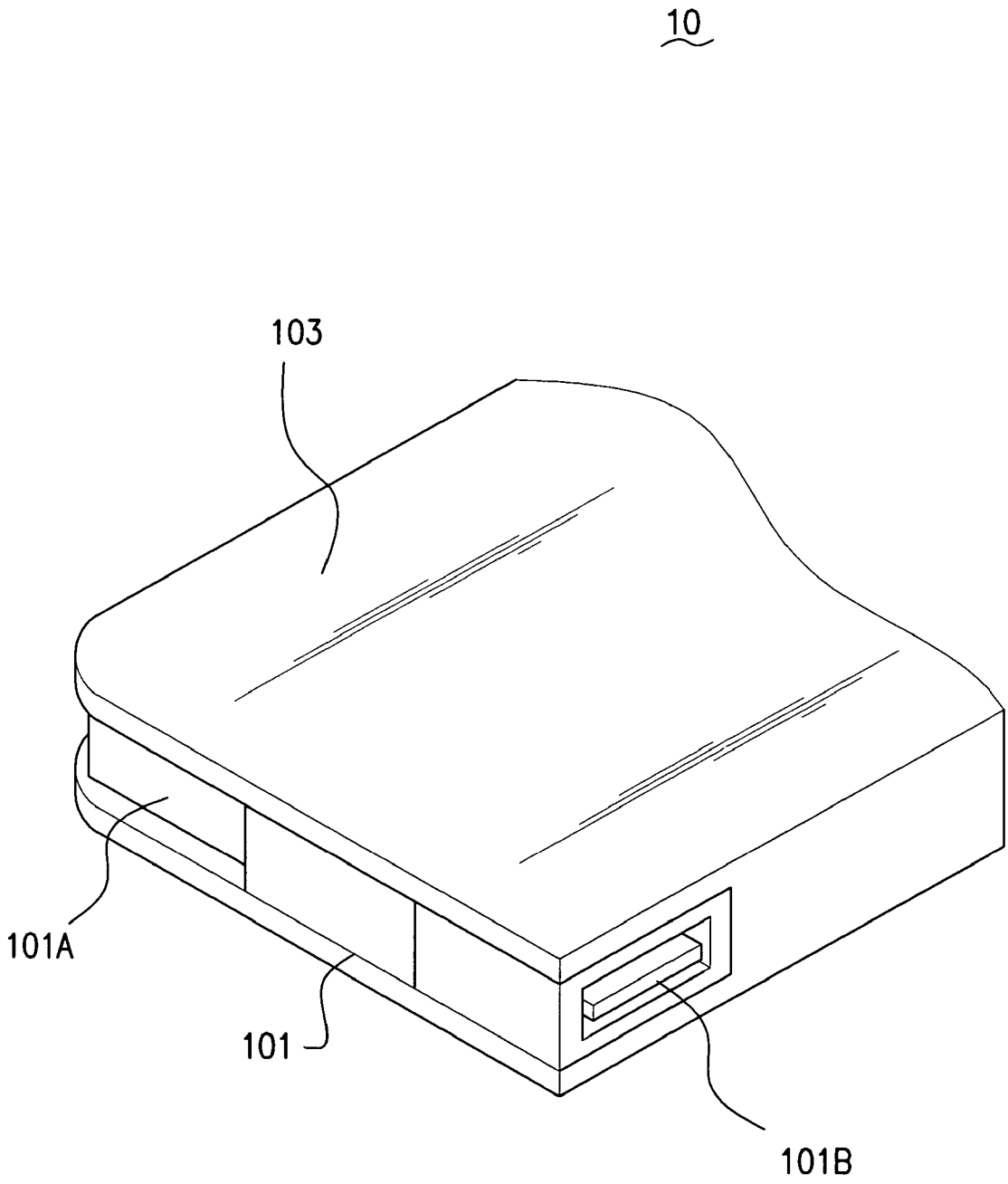
FIG. 1 shows an exploded exterior view of the bi-directional electronic device with USB interface in accordance with the present invention.
Figure 2:
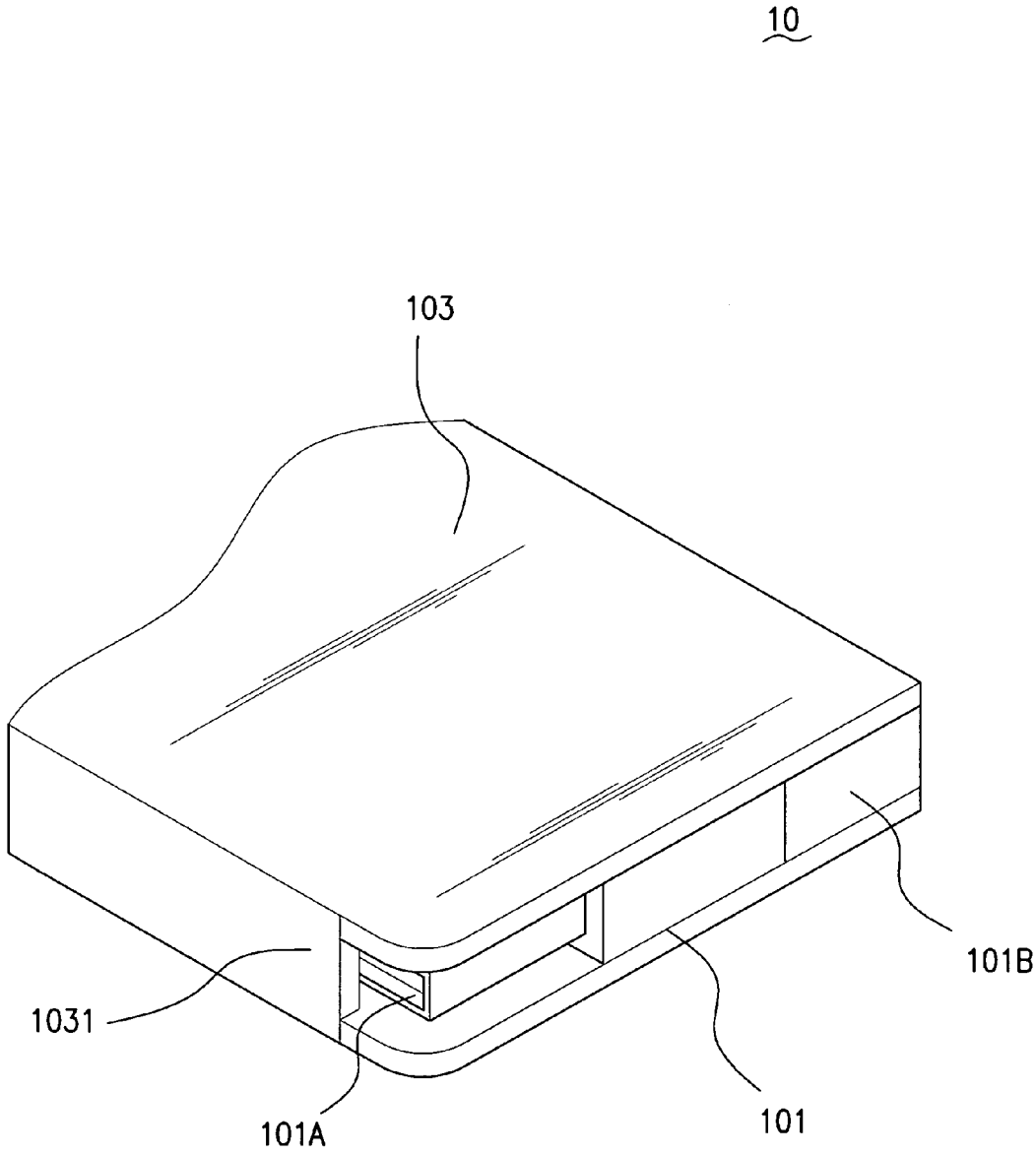
FIG. 2 shows an exploded exterior view of another side of the bi-directional electronic device with USB interface in accordance with the present invention.
Figure 3A:
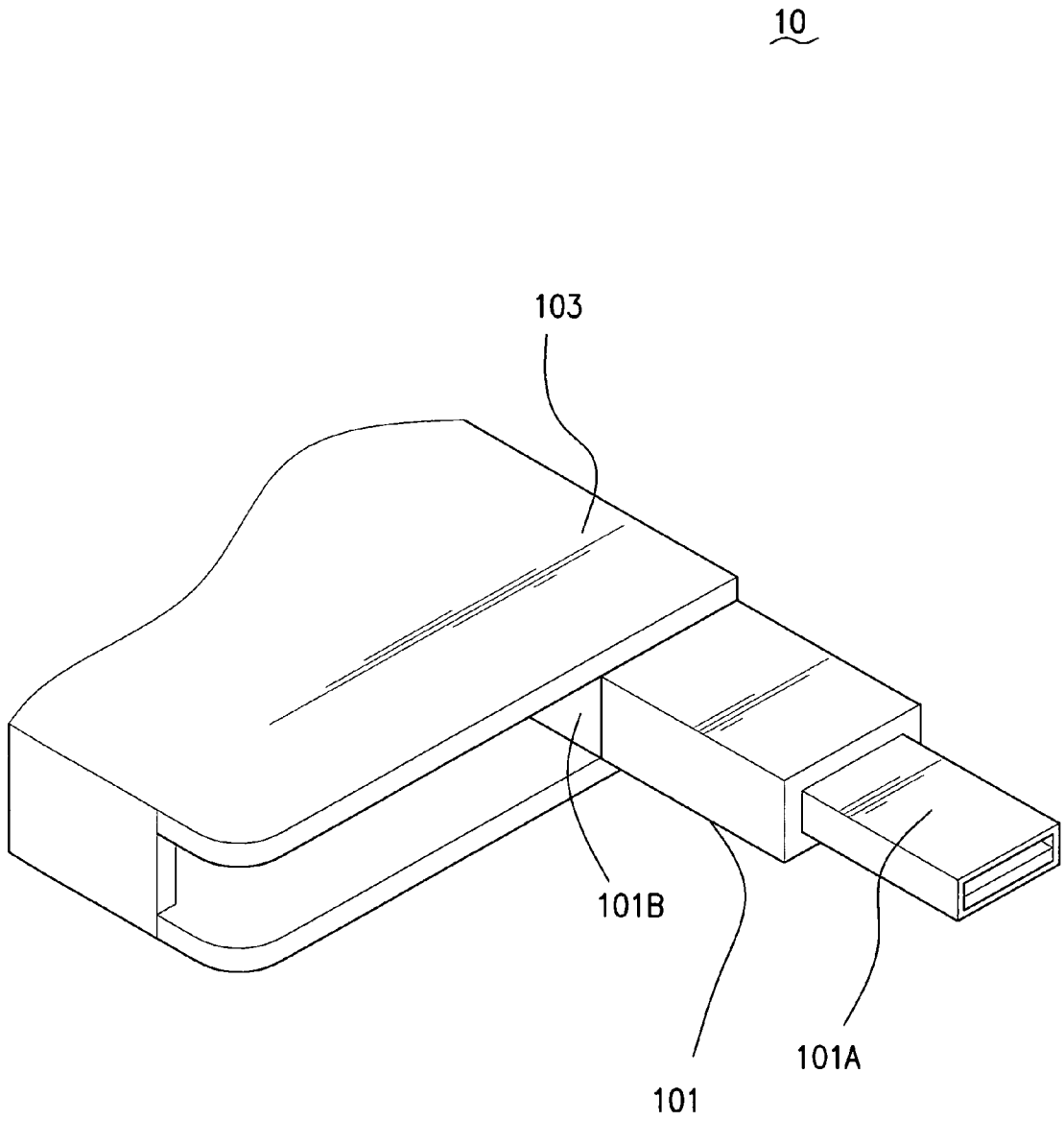
FIG. 3A and FIG. 3B respectively show the positional view of the two-in-one USB connector in accordance with the present invention.
Figure 3B:
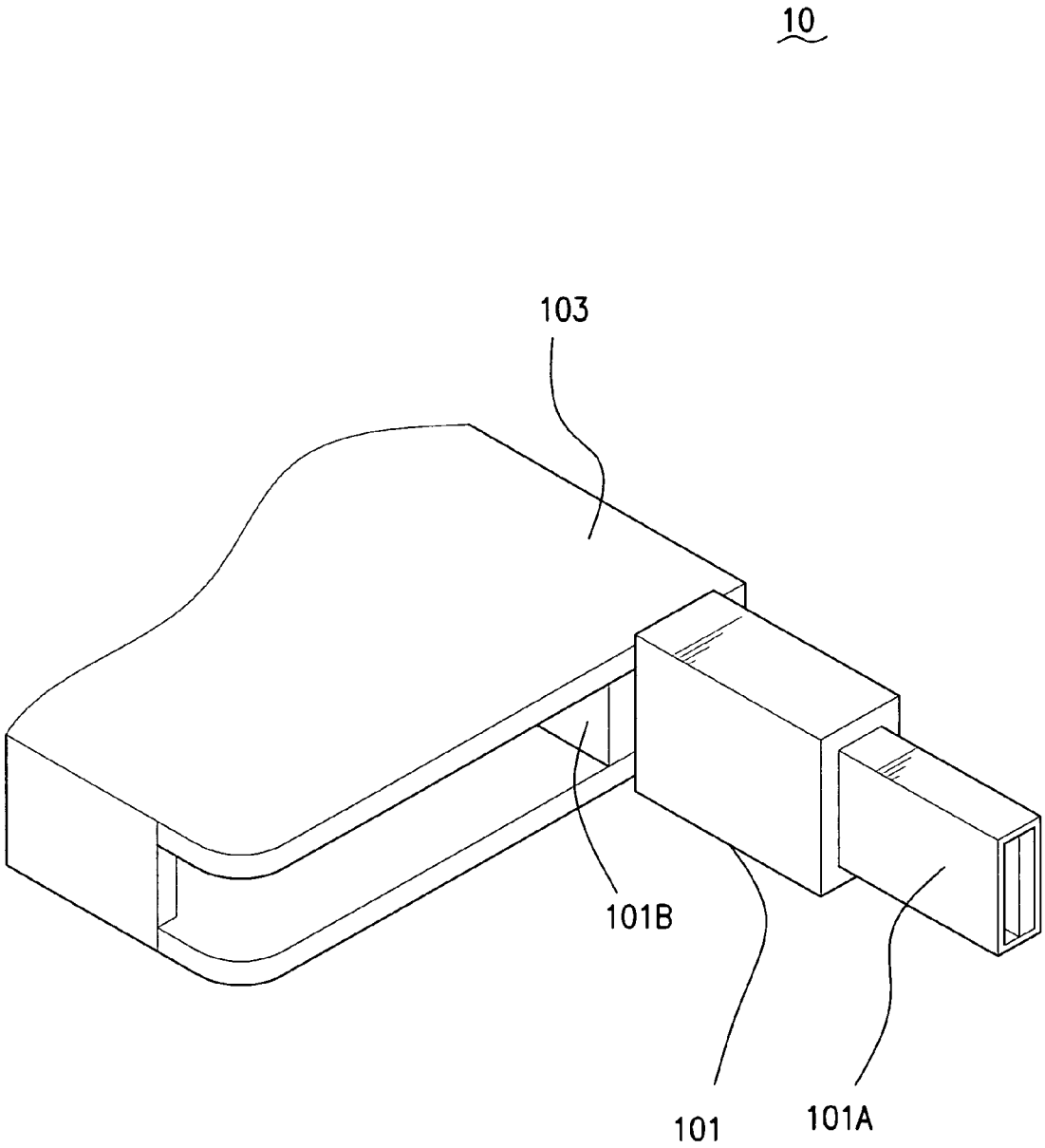

FIG. 1 shows an exploded exterior view of the bi-directional electronic device with USB interface in accordance with the present invention. The two-in-one USB connector 101 of the bi-directional electronic device with USB interface 10 in accordance with the present invention is disposed on the side of housing 103, and the connector 101 is composed of a USB standard-A type male connector 101A and a USB standard-B type female connector 101B. The connector 101 utilizes a pivoting mechanism to pivotally connect to the housing 103. The connector 101 can be completely contained within the housing 103; the connector 101 can also be pivotally rotated so as to expose the USB standard-A type male connector 101A from the housing 103. The two-in-one USB connector 101 of the present invention is characterized in that the user can only select one of the USB standards-A type male connector and a USB standard-B type female connector to be used for plugging. Refer to FIGS. 1 and 2. When the two-in-one USB connector 101 is completely contained within the housing, only USB standard-B type female connector 101B of the two-in-one connector 101 can be used for plugging, since the USB standard-A type male connector 101A is blocked by the side board 1031 of the housing 103, and thus prevents the USB standard-A type male connector 101A from being plugged. Alternatively, the width A between the two side boards of the USB standard-A type male connector 101A can be reduced to a degree as shown in FIG. 2 such that the USB female connector cannot be inserted therein. Refer to FIGS. 2, 3A, and 3B, the user pivotally rotates the two-in-one connector 101 so as to expose the USB standard-A type male connector 101A, while the USB standard-B type female connector 101B in the opposite position is concealed within the housing 103, and the USB standard-B type female connector 101B is unable to be plugged. The exposed USB standard-A type male connector 101A can be rotated further so as to change the direction of the male connector 101A.

Figure 4:
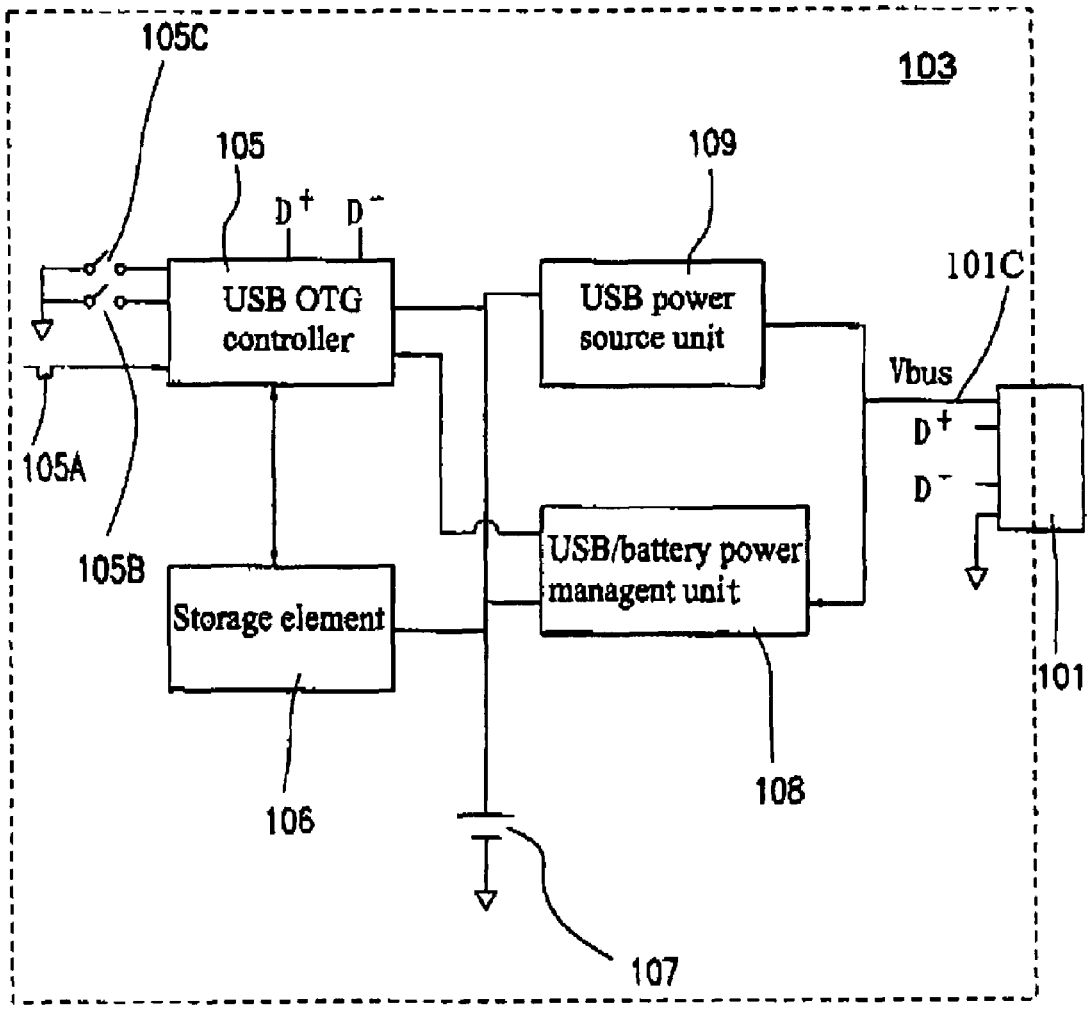
FIG. 4 shows a circuit structural view of the bi-directional electronic device with USB interface in accordance with the present invention.

FIG. 4 shows a circuit structural view of the bi-directional electronic device with USB interface in accordance with the present invention. The USB OTG controller 105 determined which operation mode to perform the electronic device 10 based on the plugging position of the USB standard-A type male connector 101A and the USB standard-B type female connector 101B of the two-in-one connector 101. The storage element 106 is connected to the USB OTG controller 105 for storing data such as MP3 songs, digital pictures, document files, video files, etc. An exemplary embodiment of the storage element 106 can be a semiconductor memory, a disk drive, a CD-ROM, a DVD-ROM, etc. The battery 107 is used for providing the power needed by the bi-directional storage device 10, and an exemplary element of the battery 107 can be a primary battery or a secondary battery. USB/battery power management unit 108 is connected to at least the USB OTG controller 105, the battery 107, and the Vbus end 101C of the two-in-one connector 101. One function of the USB/battery power management unit 108 is to detect whether the Vbus end 101C has 5V of the voltage power (or other given voltage). The USB power source unit 109 is for converting the power from the battery 107 to generate the USB power source, such as the 5V of voltage power. The USB power source is connected to the Vbus end 101C of the two-in-one connector 101.

Based on whether the current status of the bi-directional electronic device 10 is shutdown or turn on, and whether there is a 5V of voltage power existed at the Vbus end 101C, the USB OTG controller 105 determines which one of the bridging mode, OTG mode, OTG bridge switching mode, and OTG interconnecting mode is to be adopted as the designated operation mode for the bi-directional electronic device 10. The shutdown status in the present invention refers to the power off condition of the bi-directional electronic device 10, while the start status refers to the power on the condition of the bi-directional electronic device 10. The user can use the power switch 105C to switch on or switch off the power source so as to set the bi-directional electronic device 10 with power on or power off status.

Figure 5:
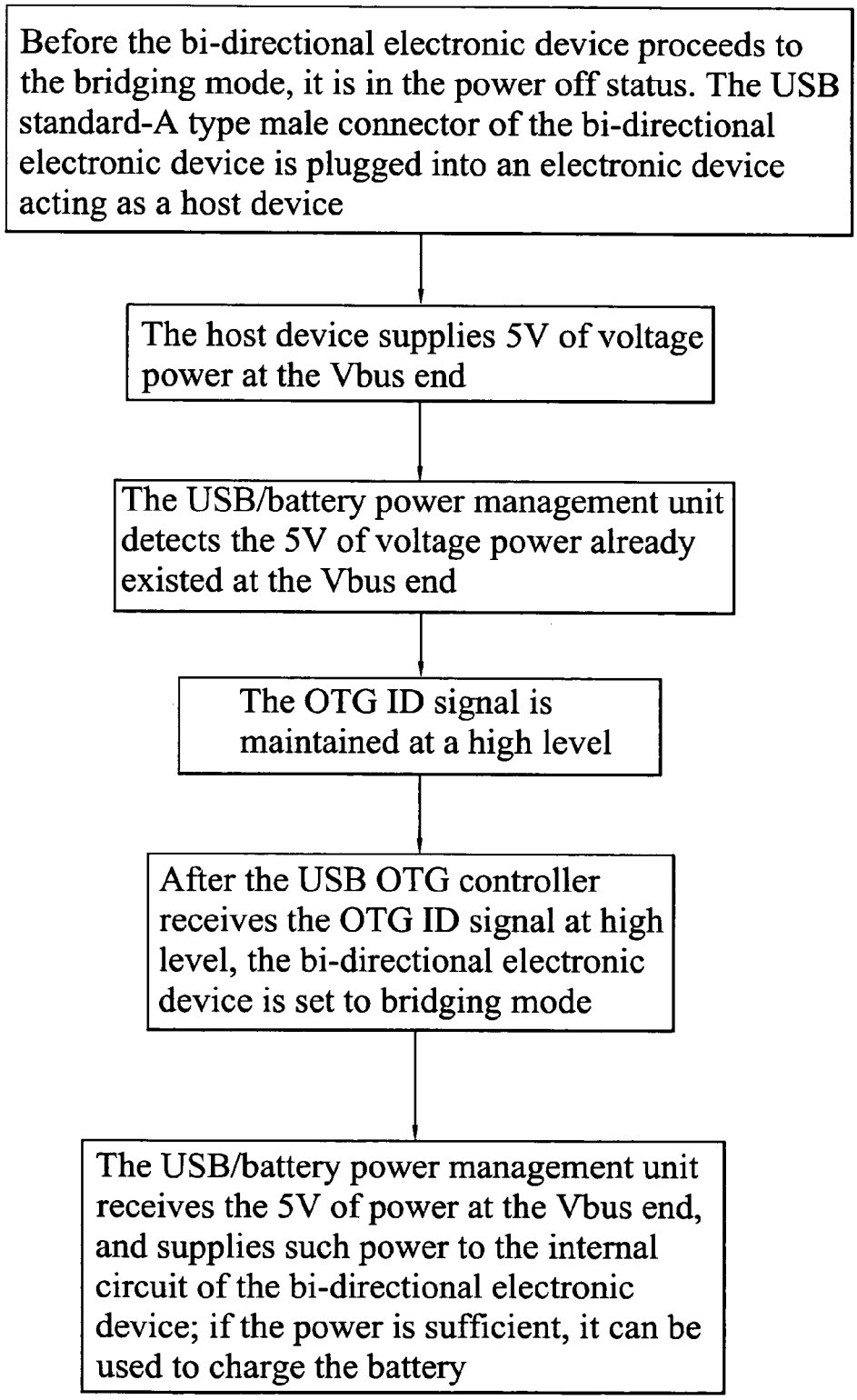
FIG. 5 shows an operational view of the bridging mode of the bi-directional electronic device with USB interface in accordance with the present invention.

FIG. 5 shows an operational view of the bridging mode of the bi-directional electronic device with USB interface in accordance with the present invention. Before the bi-directional electronic device 10 proceeds to the bridging mode, it is in the power off status. The user plugs the USB standard-A type male connector 101A of the bi-directional electronic device 10 into an electronic device acting as a host device, such as a computer. After being plugged in, the host device supplies 5V of voltage power at the Vbus end 101C, thereby the USB/battery power management unit 108 can detect the 5V of voltage power already existed at the Vbus end 101C. Afterwards, the OTG ID signal 105A is maintained at high level. After the USB OTG controller 105 receives the OTG ID signal 105A at high level, the bi-directional electronic device 10 is set to bridging mode. The USB/battery power management unit 108 receives the 5V of power at the Vbus end 101C, and supplies such power to the internal circuit of the bi-directional electronic device 10. If the power is sufficient, it can be used to charge the battery 107.

Figure 6:
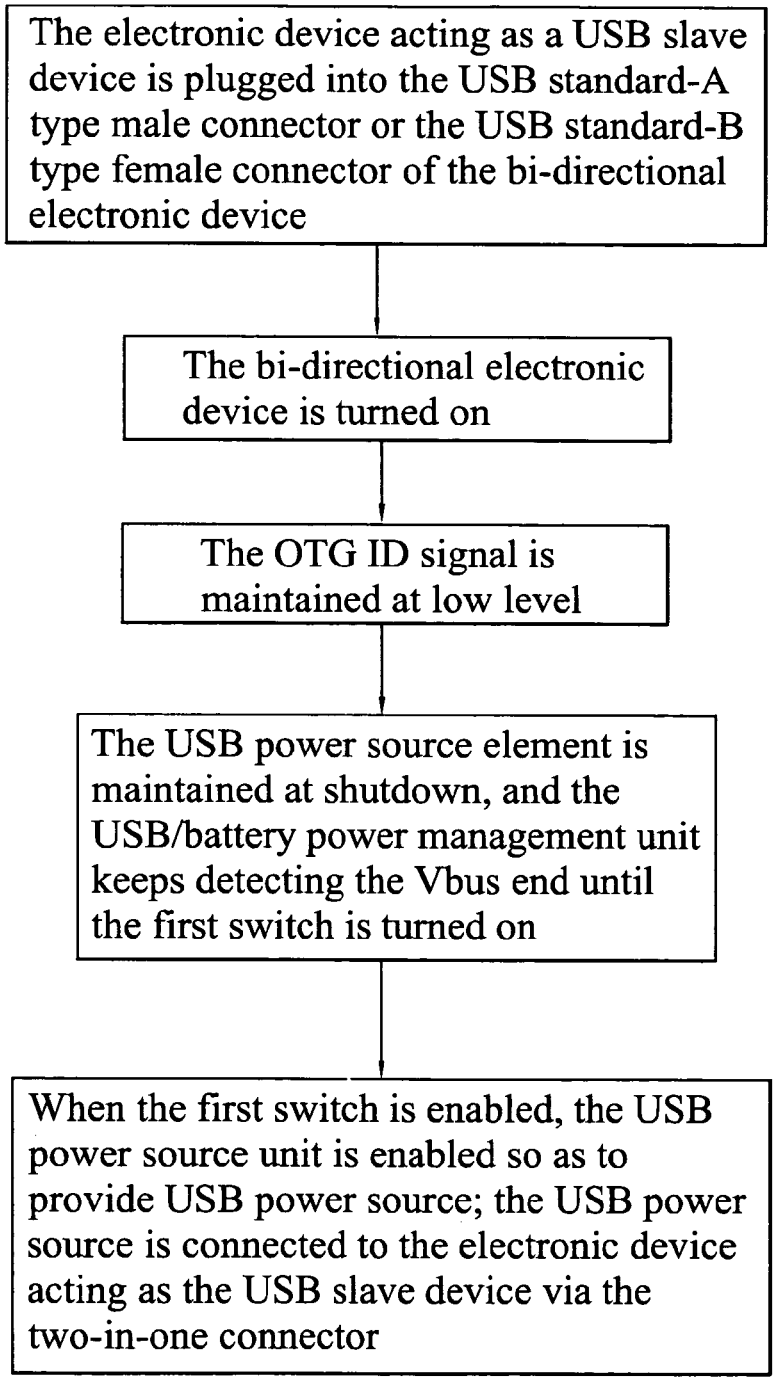
FIG. 6 shows an operational view of the OTG mode of the bi-directional electronic device with USB interface in accordance with the present invention.

FIG. 6 shows an operational view of the OTG mode of the bi-directional electronic device with USB interface in accordance with the present invention. The electronic device acting as a USB slave device, such as a portable disk, is plugged into the USB standard-A type male connector 101A or the USB standard-B type female connector 101B of the bi-directional electronic device 10. The USB slave device in the present invention refers to one that has no voltage at the Vbus end. Afterwards, the bi-directional electronic device 10 is turned on. The OTG ID signal 105A is maintained at a low level. The USB power source element 109 is maintained at shutdown, and the USB/battery power management unit 108 keeps detecting the Vbus end 101C until the first switch is turned on. The specific function of the first switch 105B is such as to instruct to perform a copy procedure. When the first switch 105B is enabled, the USB power source unit 109 is enabled so as to provide a USB power source. The USB power source is connected to the electronic device acting as the USB slave device via the two-in-one connector 101.

Figure 7:
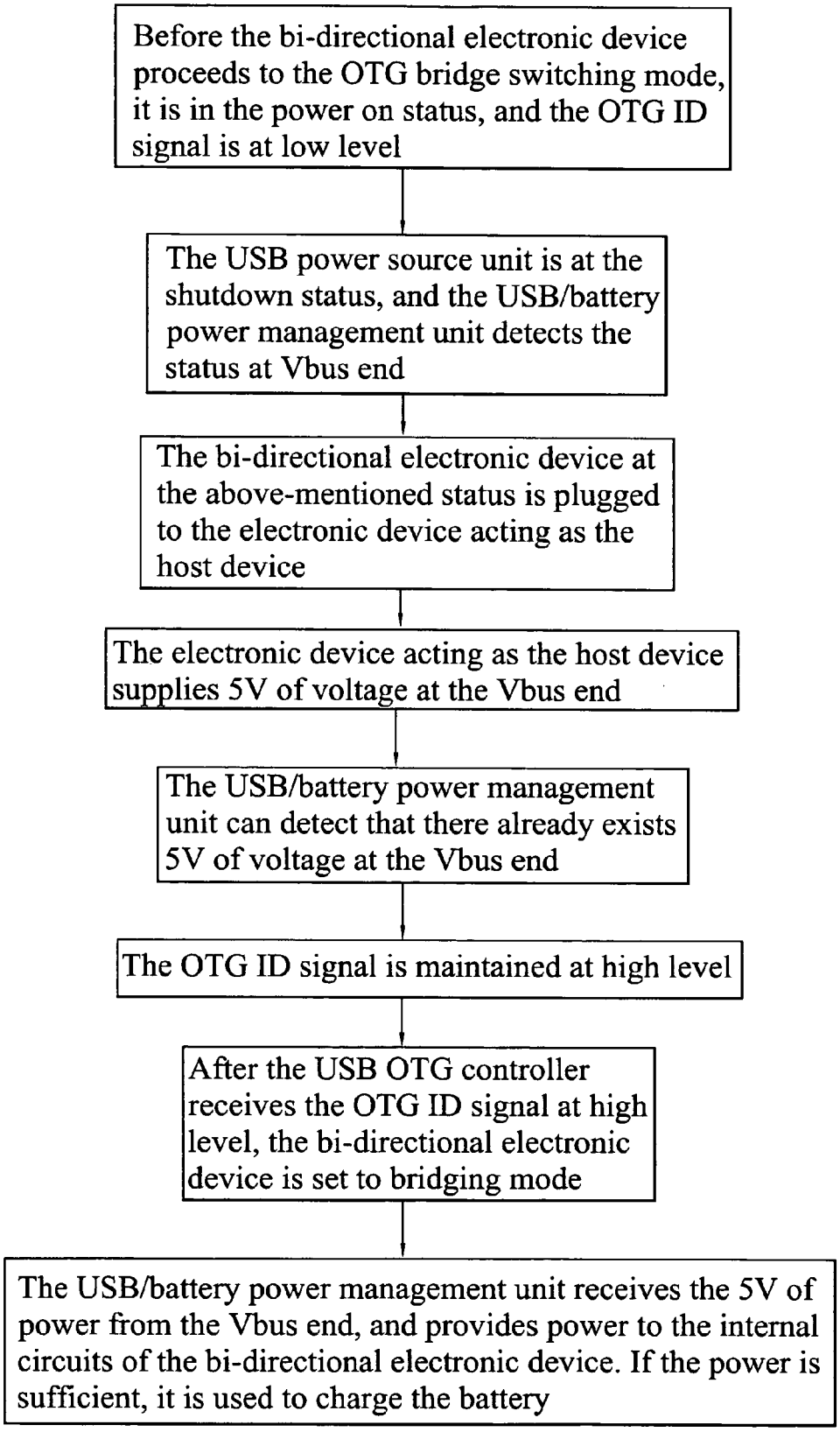
FIG. 7 shows an operational view of the OTG bridge switching mode of the bi-directional electronic device with USB interface in accordance with the present invention.

FIG. 7 shows an operational view of the OTG bridge switching mode of the bi-directional electronic device with USB interface in accordance with the present invention. Before the bi-directional electronic device 10 proceeds to the OTG bridge switching mode, it is in the power on status, and the OTG ID signal 105A is at low level. The USB power source unit 109 is at the shutdown status, and the USB/battery power management unit 108 detects the status at Vbus end 101C. The bi-directional electronic device 10 at the above-mentioned status is plugged to the electronic device acting as the host device. Afterwards, the electronic device acting as the host device supplies 5V of voltage at the Vbus end 101C. Then, the USB/battery power management unit 108 can detect that there already exists 5V of voltage at the Vbus end 101C. Afterwards, the OTG ID signal 105A is maintained at a high level. After the USB OTG controller 105 receives the OTG ID signal 105A at high level, the bi-directional electronic device 10 is set to bridging mode. The USB/battery power management unit 108 receives the 5V of power from the Vbus end 101C, and provides power to the internal circuits of the bi-directional electronic device 10. If the power is sufficient, it is used to charge the battery 107.

Figure 8:
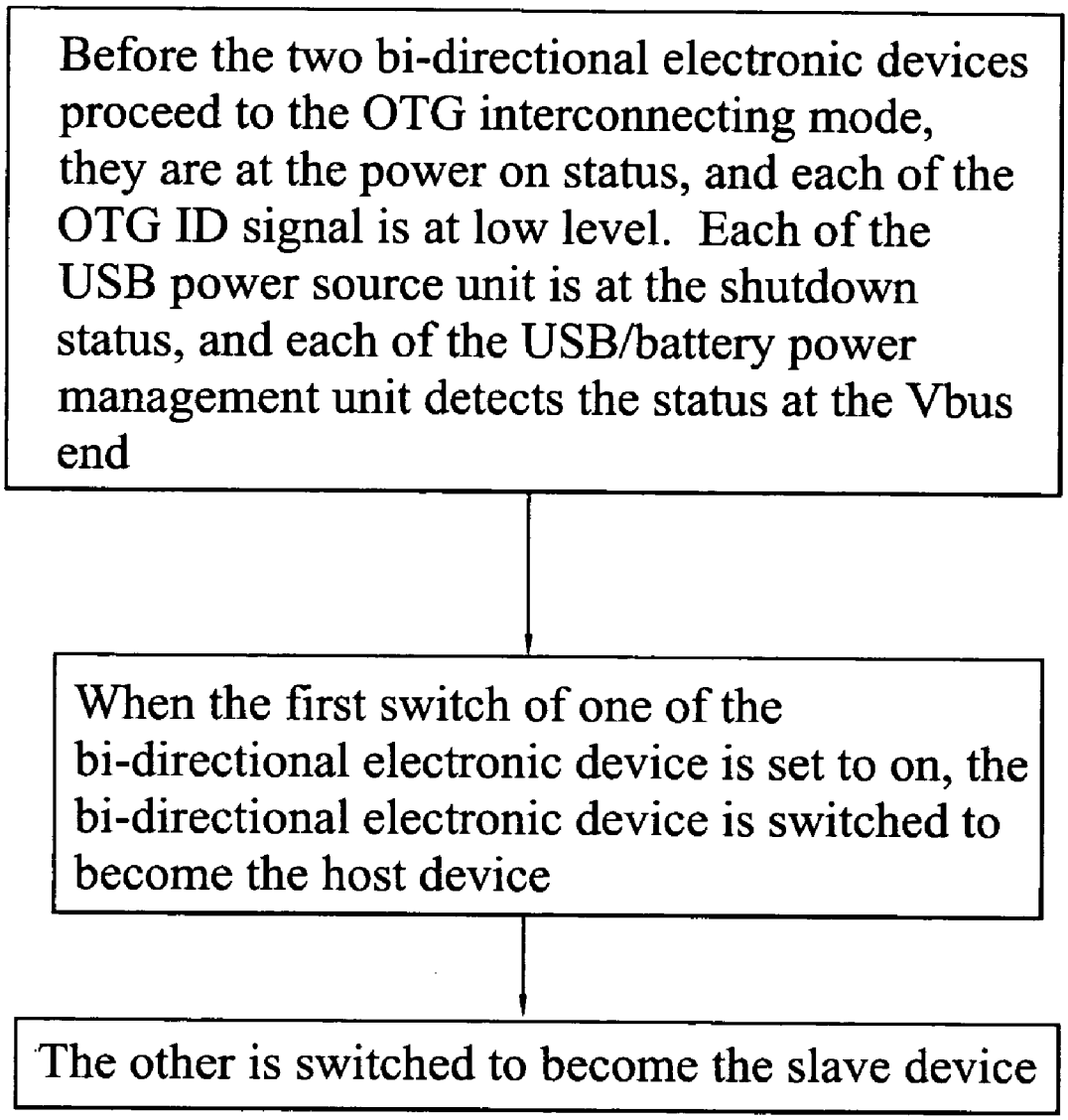
FIG. 8 shows an operational view of the OTG interconnecting mode of the bi-directional electronic device with USB interface in accordance with the present invention.

FIG. 8 shows an operational view of the OTG interconnecting mode of the bi-directional electronic device with USB interface in accordance with the present invention. Before the two bi-directional electronic devices 10 proceeds to the OTG interconnecting mode, they are at the power on status, and each of the OTG ID signals 105A is at low level. Each of the USB power source unit 109 is at the shutdown status, and each of the USB/battery power management unit 108 detects the status at the Vbus end 101C. When the first switch 105B of one of the bi-directional electronic device 10 is set to on, the bi-directional electronic device 10 is switched to become the host device, while the other is switched to become the slave device. The first switch 105B can, for example, copy switch, so as to instruct the USB OTG controller 105 to perform the copy procedure.

The bi-directional electronic device 10 of the present invention can be implemented as a MP3 player device, a video player, a portable disk, a storage device or any other portable device.

Because the present invention adopts the USB standard-A type male connector and the USB standard-B type female connector, it can be incorporated with the already popularly used electronic device with USB interface. Additionally, the special structural design between the two-in-one connector 101 and the housing 103 allows the user to use only the selected USB standard-A type male connector and the USB standard-B type female connector; meanwhile, the present invention provides the ability to automatically determine the operation mode; therefore, the present invention provides functionalities far beyond the connecting function of the conventional electronic device with USB interface.

While the preferred embodiments of the invention have been illustrated and described, it is to be understood that the invention is not so limited. Numerous modifications, changes, variations, substitutions and equivalents will occur to those skilled in the art without departing from the spirit and scope of the present invention as defined by the appended claims.

What is claimed is:

1. A bi-directional electronic device with USB interface, comprising:

a two-in-one USB connector having a USB standard-A type male connector and a USB standard-B type female connector disposed in a housing, wherein either said USB standard-A type male connector or said USB standard-B type female connector is used to connect to an external device and a voltage is accordingly supplied at a Vbus connection of said A-type and B-type USB connectors;

a USB/battery power management unit coupled to said Vbus connection to detect whether said voltage is externally supplied thereto; and a USB OTG controller for determining an operation mode of said bi-directional electronic device with said USB interface as a host or a slave USB device, said USB OTG controller having an input coupled to an output of said USB/battery power management unit and determining said operation mode responsive to said output of said USB/battery power management unit.

2. The bi-directional electronic device with USB interface of claim 1, wherein said USB standard-A type male connector is disposed at one end of said two-in-one USB connector and said USB standard-B type female connector is disposed at an opposing end of said two-in-one USB connector, said USB standard-B type female connector being pivotally connected to said housing, whereby positioning of said two-in-one USB connector for use of one of said USB standard-A type male connector or said USB standard-B type female connector precludes use of the other.

3. The bi-directional electronic device with USB interface of claim 1, further comprising:

a storage element connected to said USB OTG controller;

a battery coupled to said USB OTG controller and said USB/battery power management unit for providing power thereto;

said USB/battery power management unit being connected to said battery for coupling said voltage at said Vbus connection thereto responsive to detecting said voltage as being externally supplied;

a USB power source unit for coupling the power of said battery to said Vbus connection.

4. The bi-directional electronic device with USB interface of claim 3, wherein said storage element is selected from one of a semiconductor memory, a hard drive, a CD-ROM, and a DVD-ROM.

5. The bi-directional electronic device with USB interface of claim 1, further comprising: a first switch, connected to said USB OTG controller, said first switch instructing said USB OTG controller to perform a copy procedure based on whether said first switch is On or Off.

6. The bidirectional electronic device with USB interface of claim 1, wherein said operation mode includes a bridging mode, and said USB standard-A type male connector is connected to an electronic device acting as a host device in said bridging mode.

7. The bi-directional electronic device with USB interface of claim 1, wherein said operation mode includes an OTG mode, and said USB standard-A type male connector or said USB standard-B type female connector is connected to an electronic device acting as a USB slave device when in said OTG mode.

8. The bidirectional electronic device with USB interface of claim 1, wherein said operation mode includes a OTG bridge switching mode, when said USB standard-A type male connector or said USB standard-B type female connector is connected to an electronic device acting as a host device, said USB OTG controller is switched from said original USB OTG mode to said bridging mode.

9. The bi-directional electronic device with USB interface of claim 1, wherein said operation mode includes an OTG interconnecting mode, when a USB standard-B type female connector with a bi-directional electronic device with USB interface is connected to a USB standard-A type male connector of another bi-directional electronic device with USB interface, one of said USB OTG controller is switched to said bridging mode, while the other USB OTG controller is switched to said OTG mode.

10. A bi-directional electronic device with USB interface, comprising: a two-in-one USB connector disposed in a housing and having a USB standard-A type male connector disposed at one end thereof and a USB standard-B type female connector disposed at an opposing ends of said two-in-one USB connector, said USB standard-B type female connector being pivotally connected to said housing, whereby positioning of said two-in-one USB connector for use of one of said USB standard-A type male connector or said USB standard-B type female connector precludes use of the other.

* * * * *